US011506997B1

(12) United States Patent
Urayama et al.

(10) Patent No.: US 11,506,997 B1
(45) Date of Patent: Nov. 22, 2022

(54) DEVELOPING DEVICE AND IMAGE FORMING APPARATUS

(71) Applicant: FUJIFILM Business Innovation Corp., Tokyo (JP)

(72) Inventors: Kenta Urayama, Kanagawa (JP); Tomoyuki Yoshii, Kanagawa (JP); Yoshifumi Ozaki, Kanagawa (JP); Norihiro Tamazawa, Kanagawa (JP)

(73) Assignee: FUJIFILM Business Innovation Corp., Tokyo (JP)

( * ) Notice: Subject to any disclaimer, the term of this patent is extended or adjusted under 35 U.S.C. 154(b) by 0 days.

(21) Appl. No.: 17/411,625

(22) Filed: Aug. 25, 2021

(30) Foreign Application Priority Data

May 21, 2021 (JP) ..... JP2021-085904

(51) Int. Cl.
*G03G 15/09* (2006.01)
*G03G 15/08* (2006.01)

(52) U.S. Cl.
CPC ..... *G03G 15/0921* (2013.01); *G03G 15/0812* (2013.01); *G03G 2215/0648* (2013.01)

(58) Field of Classification Search
CPC ..... G03G 15/0921; G03G 15/0812; G03G 15/0648
See application file for complete search history.

(56) References Cited

U.S. PATENT DOCUMENTS 5,758,241 A * 5/1998 Oyama ..... G03G 15/0896 399/272
5,805,965 A * 9/1998 Tsuda ..... G03G 15/09 399/284

(Continued)

FOREIGN PATENT DOCUMENTS

JP 2007-057896 A 3/2007
JP 4344202 B2 10/2009
JP 5994405 B2 9/2016

*Primary Examiner* — Walter L Lindsay, Jr.
*Assistant Examiner* — Milton Gonzalez
(74) *Attorney, Agent, or Firm* — Sughrue Mion, PLLC

(57) ABSTRACT

A developing device includes a developing rotator configured to rotate through a developing region while carrying a magnetic developer, a supply transport member configured to rotate to transport the developer to be supplied to the developing rotator, a non-magnetic movement assist member arranged between the developing rotator and the supply transport member, and having a slope that receives the developer from the supply transport member and moves the developer to the developing rotator, a first adjusting member having a facing surface that faces, with distances, the slope of the movement assist member and a surface of the developing rotator at a part passing over the movement assist member, and configured to adjust a movement amount of the developer from the movement assist member to the developing rotator and a carrying amount of the developer on the surface of the developing rotator, and a second adjusting member having a distance from the surface of the developing rotator at a part passing over the first adjusting member, and configured to adjust the carrying amount of the developer on the surface of the developing rotator before the developer reaches the developing region. A first minimum distance between the slope of the movement assist member and the facing surface of the first adjusting member, a second minimum distance between the facing surface of the first adjusting member and the surface of the developing rotator, and a third minimum distance between the second adjusting member and the surface of the developing rotator are reduced in descending order.

20 Claims, 14 Drawing Sheets

(56) References Cited

U.S. PATENT DOCUMENTS

| | | | | |
|---|---|---|---|---|
| 6,337,957 | B1 * | 1/2002 | Tamaki | G03G 15/09 399/258 |
| 7,003,250 | B2 * | 2/2006 | Sano | G03G 15/0812 399/284 |
| 8,942,602 | B2 * | 1/2015 | Onoda | G03G 15/0921 399/275 |
| 9,207,568 | B2 * | 12/2015 | Lee | G03G 15/081 |
| 2008/0298848 | A1 * | 12/2008 | Lee | G03G 15/0812 399/274 |

* cited by examiner

DEVELOPING DEVICE AND IMAGE FORMING APPARATUS

CROSS-REFERENCE TO RELATED APPLICATIONS

This application is based on and claims priority under 35 USC 119 from Japanese Patent Application No. 2021-085904 filed May 21, 2021.

BACKGROUND

(i) Technical Field

The present disclosure relates to a developing device and an image forming apparatus.

(ii) Related Art

Japanese Patent No. 4344202 (claim 1, FIG. 1) describes a developing device including a developer carrier that carries a two-component developer, a first regulating member that regulates the amount of the developer carried on the developer carrier, a developer containing portion that contains the developer scraped by the first regulating member, and a toner supply opening that adjoins the developer containing portion and supplies toner to the developer carrier. The developer containing portion includes a second regulating member arranged on an upstream side in a transport direction of the developer on the developer carrier relative to the first regulating member. The second regulating member has a clearance from the developer carrier to restrict passage of an increasing part of the developer when the concentration of the toner in the developer on the developer carrier increases and the layer thickness of the developer increases. A non-magnetic assist member projecting into the developer containing portion is provided at each end of the second regulating member except the center of the second regulating member in its longitudinal direction.

SUMMARY

Aspects of non-limiting embodiments of the present disclosure relate to a developing device and an image forming apparatus. When the carrying amount of a magnetic developer on the surface of a developing rotator that rotates through a developing region while carrying the developer is finally adjusted by a second adjusting member before the developer reaches the developing region, the amount of the developer supplied from a supply transport member to the surface of the developing rotator and reaching the second adjusting member may be made more stable than in a case where a first adjusting member is provided to adjust the movement amount of the developer from a movement assist member to the developing rotator and the carrying amount of the developer on the surface of the developing rotator and a minimum distance between a slope of the movement assist member and a facing surface of the first adjusting member, a minimum distance between the facing surface of the first adjusting member and the surface of the developing rotator, and a minimum distance between the second adjusting member and the surface of the developing rotator are not reduced in descending order.

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address advantages described above.

According to an aspect of the present disclosure, there is provided a developing device comprising a developing rotator configured to rotate through a developing region while carrying a magnetic developer, a supply transport member configured to rotate to transport the developer to be supplied to the developing rotator, a non-magnetic movement assist member arranged between the developing rotator and the supply transport member, and having a slope that receives the developer from the supply transport member and moves the developer to the developing rotator, a first adjusting member having a facing surface that faces, with distances, the slope of the movement assist member and a surface of the developing rotator at a part passing over the movement assist member, and configured to adjust a movement amount of the developer from the movement assist member to the developing rotator and a carrying amount of the developer on the surface of the developing rotator, and a second adjusting member having a distance from the surface of the developing rotator at a part passing over the first adjusting member, and configured to adjust the carrying amount of the developer on the surface of the developing rotator before the developer reaches the developing region. A first minimum distance between the slope of the movement assist member and the facing surface of the first adjusting member, a second minimum distance between the facing surface of the first adjusting member and the surface of the developing rotator, and a third minimum distance between the second adjusting member and the surface of the developing rotator are reduced in descending order.

BRIEF DESCRIPTION OF THE DRAWINGS

Exemplary embodiments of the present disclosure will be described in detail based on the following figures, wherein.

DETAILED DESCRIPTION

Exemplary embodiments of the present disclosure are described below with reference to the drawings.

First Exemplary Embodiment

Figure 1:
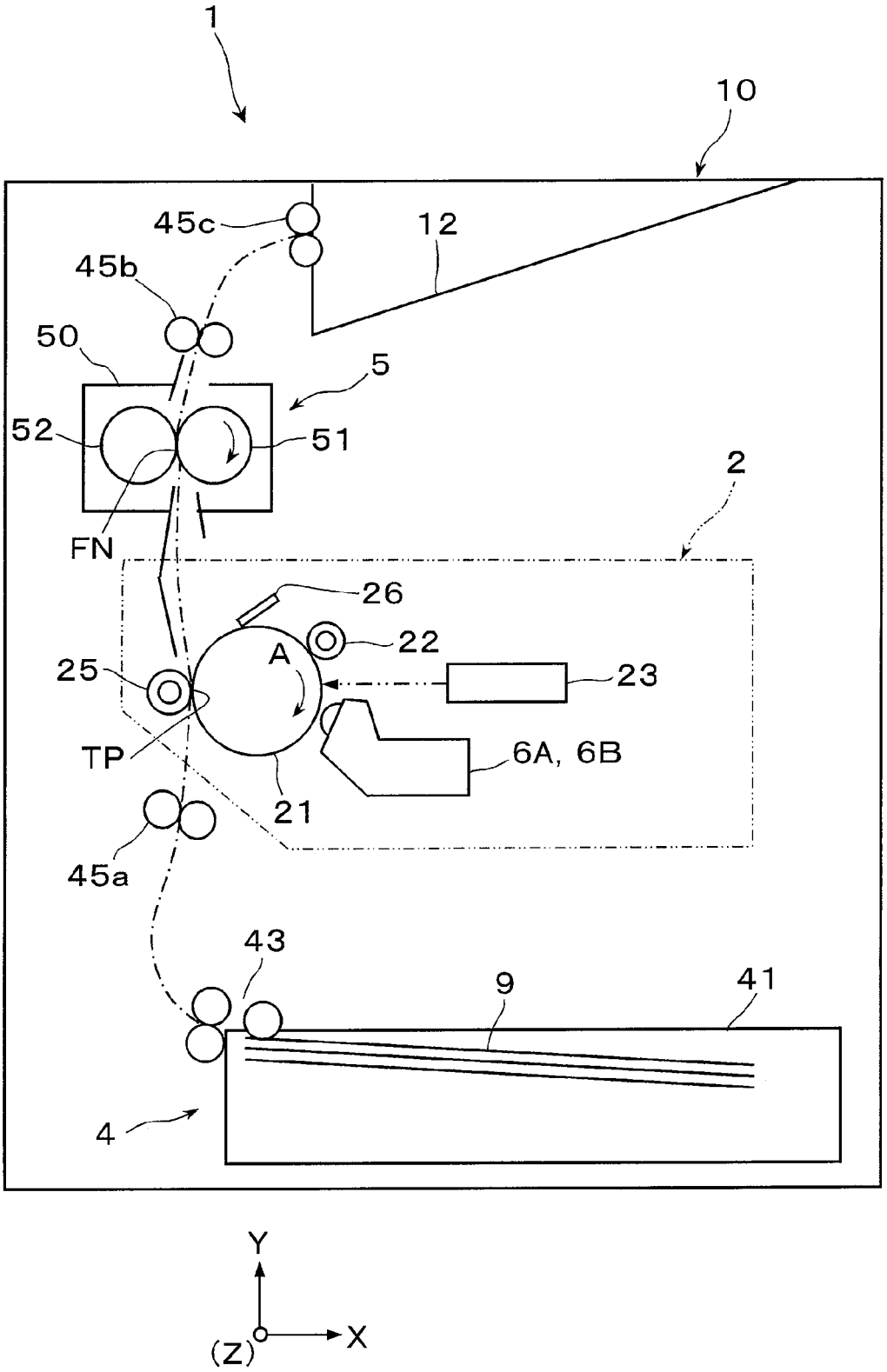
FIG. 1 illustrates an image forming apparatus according to a first exemplary embodiment.

FIG. 1 illustrates an image forming apparatus 1 using a developing device 6A according to a first exemplary embodiment of the present disclosure.

Arrows X, Y, and Z in FIG. 1 and other figures represent a lateral direction (horizontal direction), an up-and-down direction (vertical direction), and a fore-and-aft direction (horizontal direction). In each figure, a circle at an intersection of the X and Y directions represents that the Z direction corresponds to a direction perpendicular to the figure (drawing sheet) toward a far side.

<Image Forming Apparatus>

As illustrated in FIG. 1, the image forming apparatus 1 includes an image former 2, a paper feeder 4, a fixing device 5, and a controller (not illustrated) in an internal space of a housing 10 having an appropriate appearance. The image former 2 forms a toner image with toner serving as a developer based on image information, and transfers the toner image onto recording paper 9 that is an example of a recording medium. The paper feeder 4 stores the recording paper 9, and feeds the recording paper 9 to a transfer position of the image former 2. The fixing device 5 fixes the transferred toner image onto the recording paper 9.

In FIG. 1, a chain line represents a transport path of the recording paper 9 in the housing 10.

The image former 2 includes a photoconductor drum 21 that is an example of a latent image carrier that forms and carries a latent image. A charging device 22, an exposing device 23, the developing device 6A, a transfer device 25, and a cleaner 26 are arranged around the photoconductor drum 21.

The photoconductor drum 21 rotates in an arrow A direction about a rotational axis (not illustrated) extending along the depth direction Z. The charging device 22 charges the outer peripheral surface of the photoconductor drum 21 (image forming surface) at an appropriate surface potential. The charging device 22 includes a charging member such as a roller that supplies a charging current in contact with an image forming region on the outer peripheral surface of the photoconductor drum 21. The exposing device 23 forms an electrostatic latent image by exposing the charged outer peripheral surface of the photoconductor drum 21 with light based on image information.

The developing device 6A develops the formed electrostatic latent image into a visible toner image with a developer (toner) of a predetermined color (e.g., black). Details of the developing device 6A are described later.

The transfer device 25 electrostatically transfers the formed toner image onto the recording paper 9. The transfer device 25 includes a transfer member such as a roller that supplies a transfer current in contact with the outer peripheral surface of the photoconductor drum 21. The cleaner 26 cleans the outer peripheral surface of the photoconductor drum 21 by removing (scraping) waste such as unnecessary toner or paper dust adhering to the outer peripheral surface of the photoconductor drum 21.

In the image former 2, a transfer position TP of the toner image is a position where the photoconductor drum 21 and the transfer device 25 face each other.

The paper feeder 4 is arranged below the image former 2. The paper feeder 4 includes a container 41 that contains sheets of recording paper 9, and a sender 43 that sends the sheets of recording paper 9 one by one.

The recording paper 9 is any medium such as plain paper, coated paper, or cardboard that may be transported in the housing 10 and subjected to transfer and fixing of the toner image. The material and shape of the recording paper 9 are not particularly limited.

The fixing device 5 is arranged above the transfer position TP of the image former 2. The fixing device 5 includes a heating rotator 51 and a pressurizing rotator 52 in an internal space of a housing 50 having an entrance and an exit for the recording paper 9.

In the fixing device 5, the heating rotator 51 and the pressurizing rotator 52 are in contact with each other substantially in a horizontal posture. In the fixing device 5, the contact portion between the heating rotator 51 and the pressurizing rotator 52 is a fixing portion (nip) FN where the unfixed toner image is fixed onto the recording paper 9 by heating and pressurizing.

The transport path of the recording paper 9 in the housing 10 is defined by a plurality of transport rollers 45*a*, 45*b*, and 45*c* that nip and transport the recording paper 9, and a plurality of guide members (not illustrated) that guide the recording paper 9 by securing a transport space for the recording paper 9.

In the image forming apparatus 1, the controller (not illustrated) that has received an image forming operation command causes the image former 2 to perform charging, exposing, developing, and transferring operations, and causes the paper feeder 4 to feed the recording paper 9 toward the transfer position TP.

After a toner image is formed on the photoconductor drum 21, the toner image is transferred onto the recording paper 9 fed from the paper feeder 4 to the transfer position TP.

In the image forming apparatus 1, the recording paper 9 having the transferred toner image is transported to the nip FN of the fixing device 5 to perform a fixing operation.

Thus, the unfixed toner image is fixed onto the recording paper 9.

For example, the recording paper 9 subjected to the fixing operation is transported by the transport rollers 45*b* and 45*c* and then output to and received by an output receiver 12 at the top of the housing 10.

In the manner described above, the image forming operation for forming the toner image on one side of the recording paper 9 is completed.

<Developing Device>

Next, the developing device 6A according to the first exemplary embodiment is described in detail.

Figure 2:
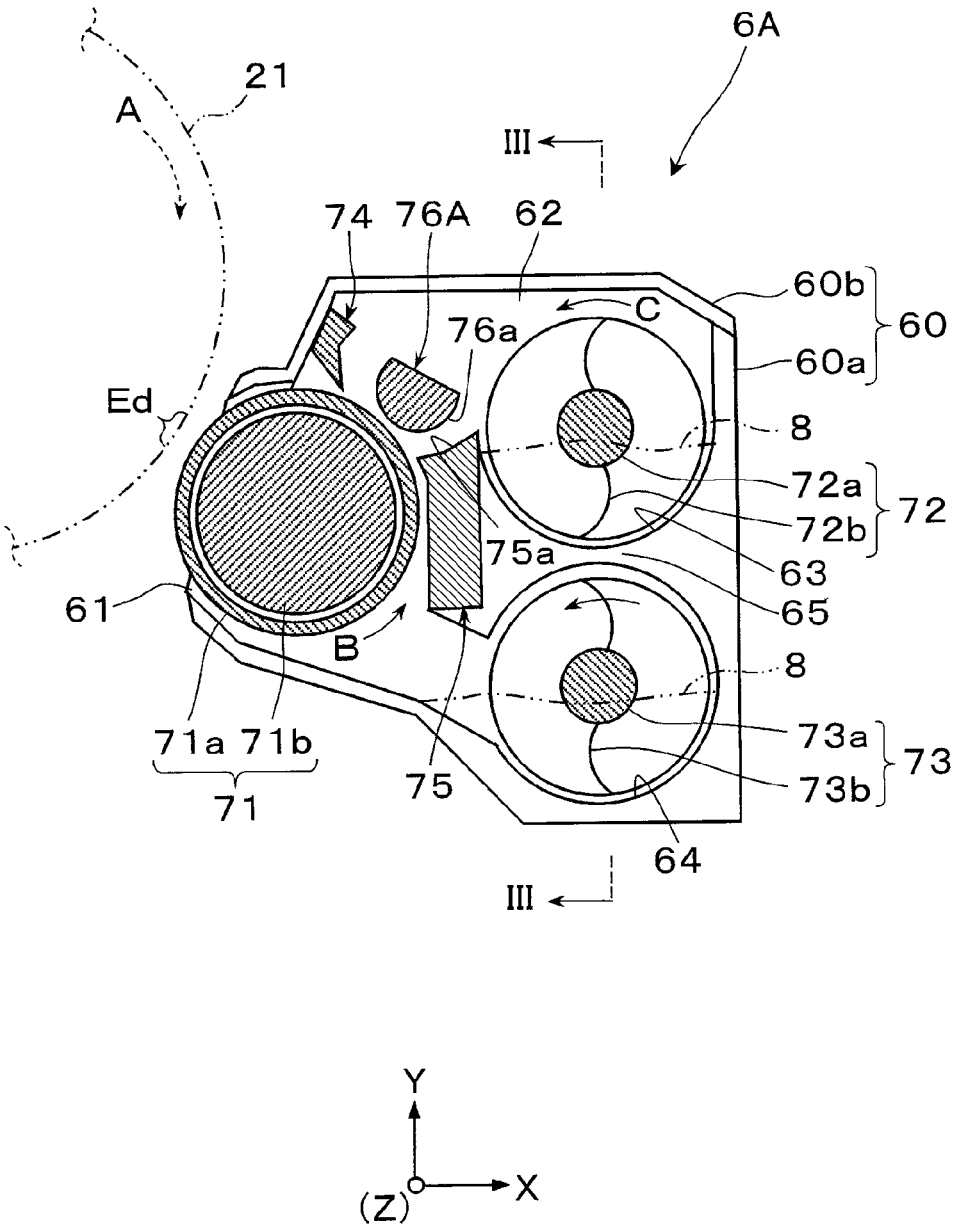
FIG. 2 illustrates a developing device according to the first exemplary embodiment.

As illustrated in FIG. 2, the developing device 6A includes a housing 60 having a container-shaped lower portion 60*a* open at the top, and a lid-shaped upper portion 60*b* that closes the top of the lower portion 60*a*. The housing 60 has a developing opening 61 and a containing portion 62 that contains a magnetic developer 8. Examples of the magnetic developer 8 include a two-component developer including non-magnetic toner and a magnetic carrier.

The opening 61 is a rectangular opening elongated in the depth direction Z along the rotational axis of the photoconductor drum 21 and facing a developing region Ed where a latent image is developed. The opening 61 is connected to the containing portion 62. A developing roller 71 that is an example of a developing rotator is arranged in the lower portion 60*a* at a position near the opening 61 of the housing 60. The developing roller 71 rotates through the developing region Ed while carrying the developer 8.

The developing roller 71 includes a developing sleeve 71*a* that is an example of a cylindrical member that rotates while carrying the developer 8, and a magnet roller 71*b* that is an example of a magnet member fixed in an internal space of the developing sleeve 71*a*.

Figure 4:
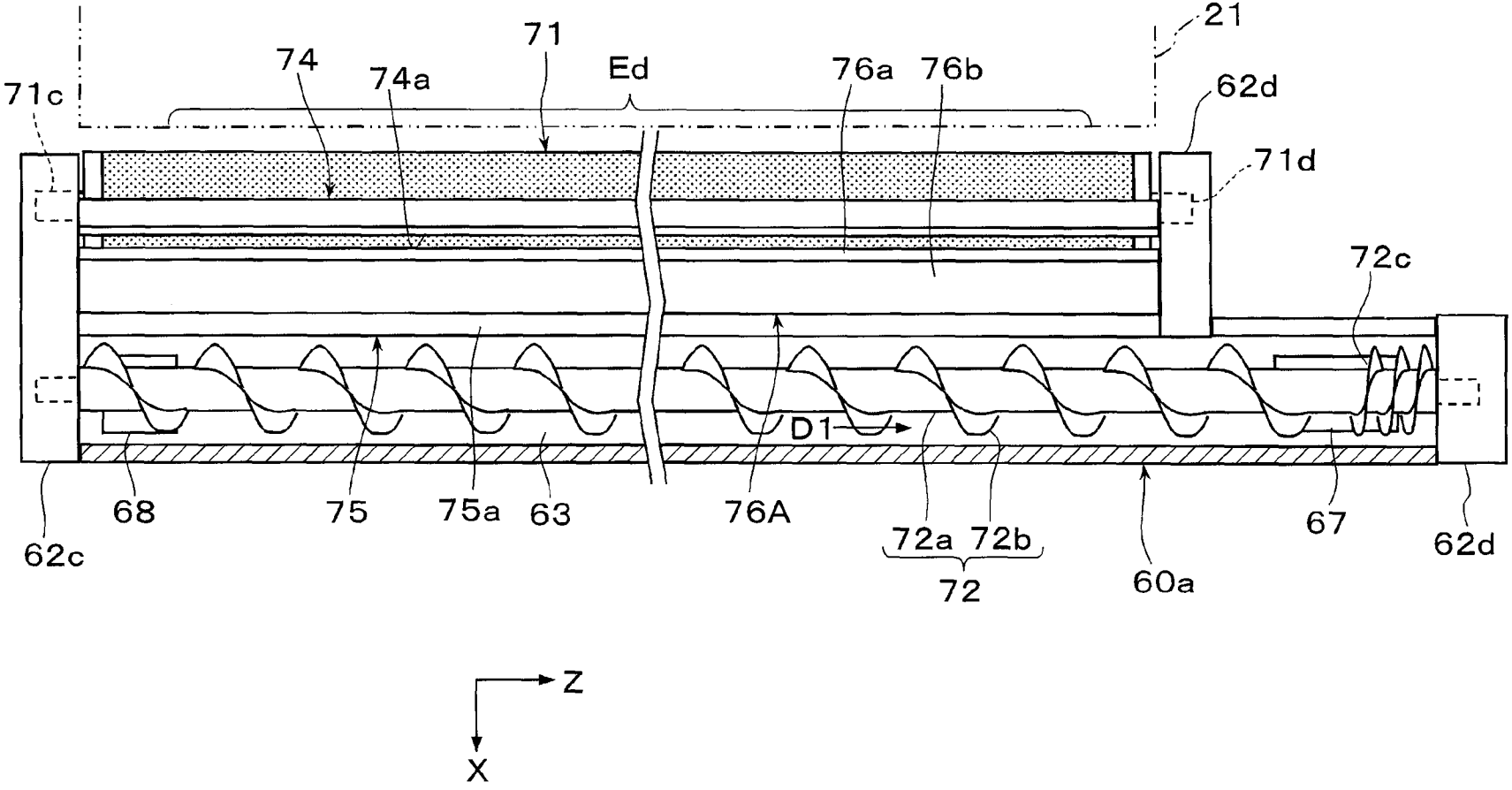
FIG. 4 illustrates the developing device with its upper housing portion removed.
Figure 5:
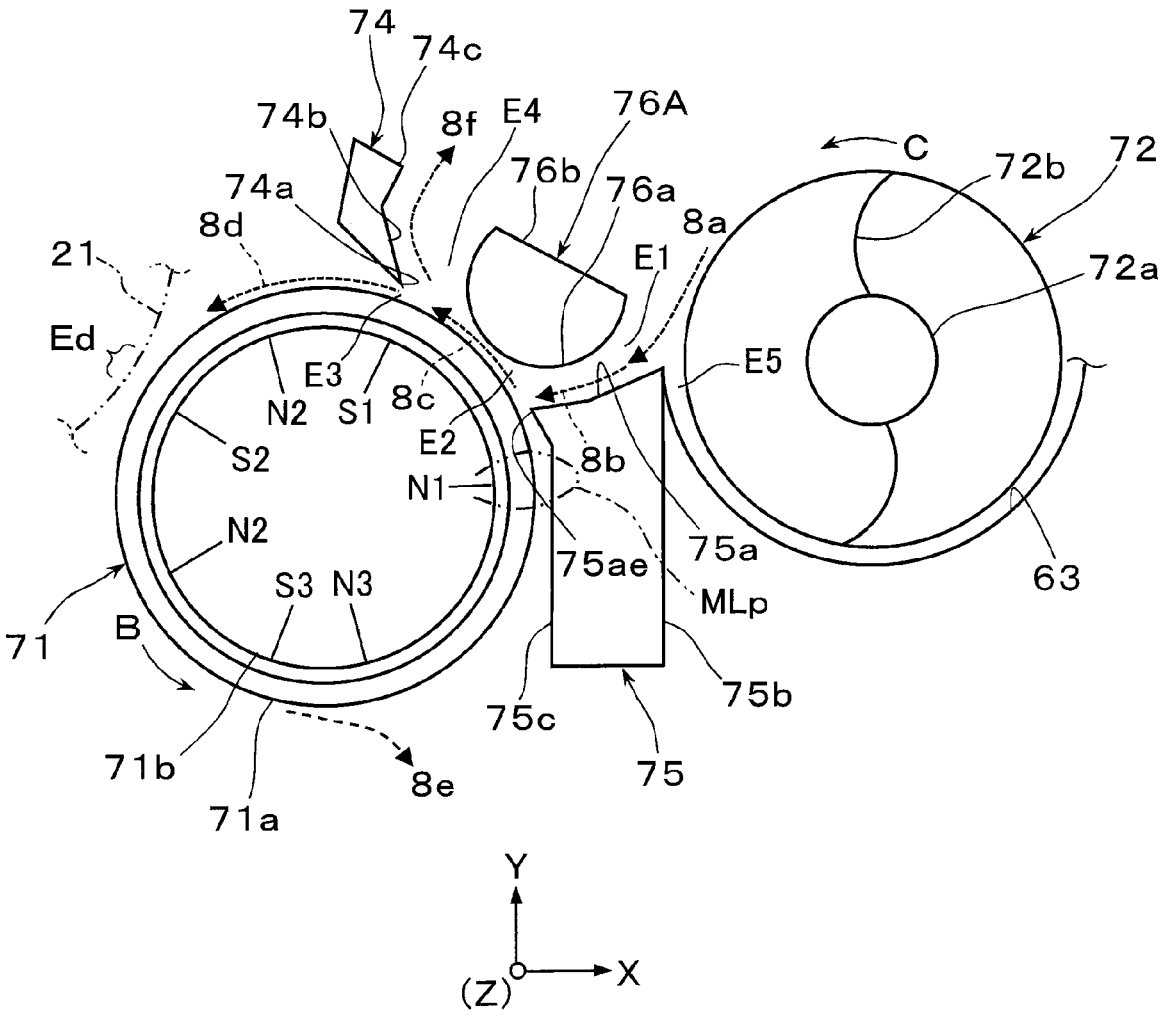
FIG. 5 illustrates a part of the developing device and its operating state.

The developing sleeve 71*a* is made of a non-magnetic material. As illustrated in FIG. 4, shafts 71*c* and 71*d* at both ends of the developing sleeve 71*a* are attached to left and right side walls 62*c* and 62*d* of the containing portion 62 or to a support frame (not illustrated), and are driven to rotate in an arrow B direction by transmitting rotational power of a rotational driver (not illustrated). A developing bias from a power supply (not illustrated) is supplied between the developing sleeve 71*a* and the photoconductor drum 21. The magnet roller 71*b* has a plurality of magnetic poles that generate magnetic forces for exerting functions of attracting (picking up), carrying, and separating the developer 8 on the surface of the developing sleeve 71*a*. In FIG. 5, N1 represents a pickup pole, S1 represents a trimmer pole, N2 represents a carrying pole, S2 represents a developing pole, and S3 and N3 represent separation poles.

Figure 3:
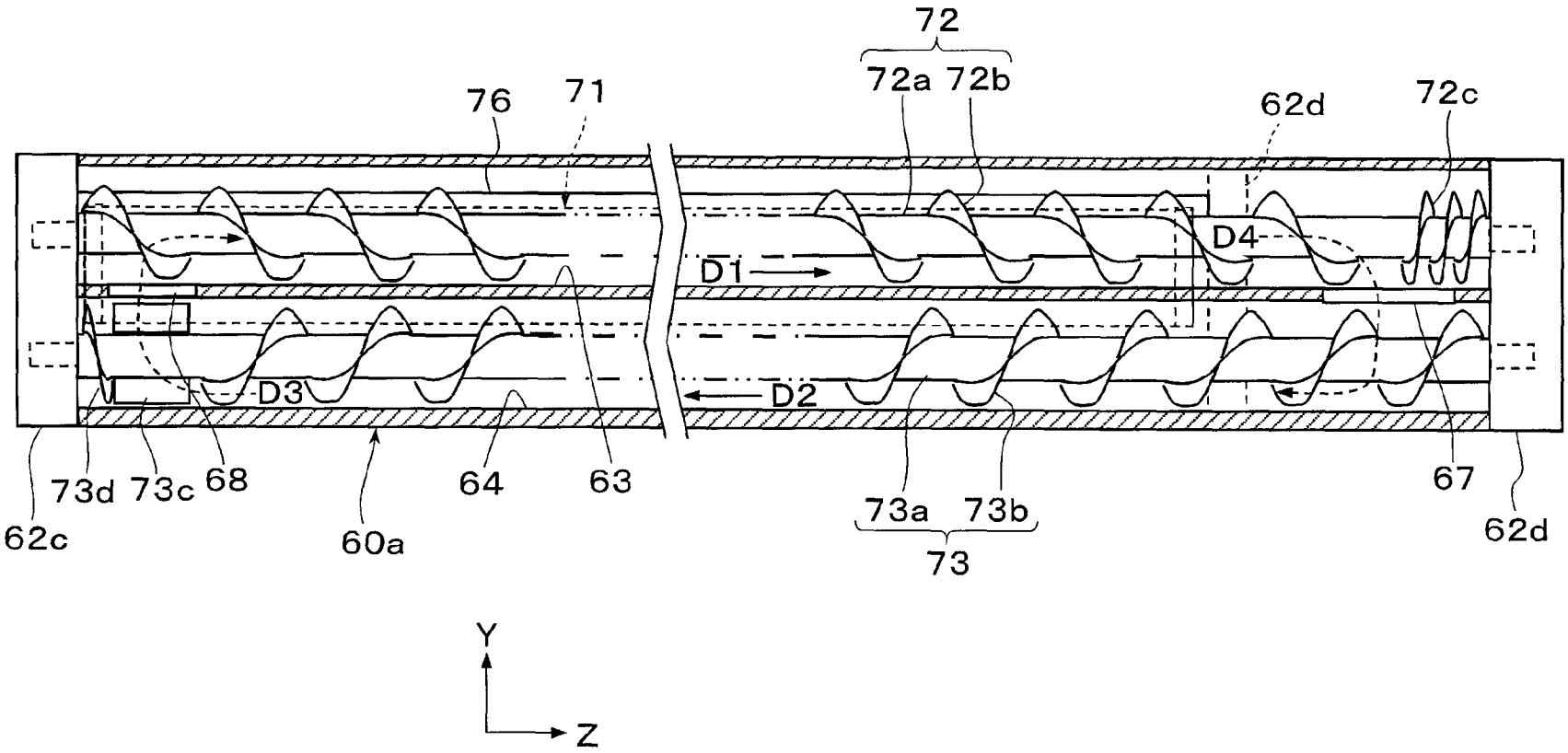
FIG. 3 is a partial sectional view taken along the line III-III in the developing device of FIG. 2.

As illustrated in FIG. 2 to FIG. 4, the containing portion 62 has a first transport path 63 where the developer 8 is transported to the developing roller 71, and a second transport path 64 where the developer 8 is transported to the first transport path 63.

The first transport path 63 and the second transport path 64 are grooves extending substantially parallel to the developing roller 71. The first transport path 63 and the second transport path 64 are partitioned from each other by a partition 65 provided therebetween in the up-and-down direction, and are connected to each other by a penetrating first connection portion 67 and a penetrating second connection portion 68 provided at parts behind a downstream end and an upstream end in a transport direction. The developer 8 is transported from one of the first transport path 63 and the second transport path 64 to the other at the first connection portion 67 or the second connection portion 68. Thus, the first transport path 63 and the second transport path 64 serve as a circulation path where the developer 8 circulates.

A first screw auger 72 is arranged in the first transport path 63 as an example of a first transport member that transports the developer 8 forward in a first transport direction D1 while stirring the developer 8. In this exemplary embodiment, the first screw auger 72 is also an example of a supply transport member that rotates to transport the developer 8 to be supplied to the developing roller 71.

In the first screw auger 72, a forward transport blade 72*b* is helically coiled around a round rotational shaft 72*a* at a predetermined height, a predetermined inclination angle, and a predetermined pitch. The rotational shaft 72*a* rotates in the first transport path 63. The forward transport blade 72*b* transports the developer 8 forward in the first transport direction D1. In the first screw auger 72, a reverse transport blade 72*c* is helically coiled around the rotational shaft 72*a* at a downstream end in the first transport direction D1 that is adjacent to the first connection portion 67. The reverse transport blade 72*c* is coiled in a direction opposite to the coiling direction of the forward transport blade 72*b*. The reverse transport blade 72*c* transports the developer 8 in a direction opposite to the first transport direction D1. The uppermost portion of the first screw auger 72 of this exemplary embodiment is positioned higher than the uppermost portion of the developing roller 71 in the up-and-down direction along the gravity direction.

A second screw auger 73 is arranged in the second transport path 64 as an example of a second transport member that transports the developer 8 forward in a second transport direction D2 while stirring the developer 8.

In the second screw auger 73, a forward transport blade 73*b* is helically coiled around a round rotational shaft 73*a* at a predetermined height, a predetermined inclination angle, and a predetermined pitch. The rotational shaft 73*a* rotates in the second transport path 64. The forward transport blade 73*b* transports the developer 8 forward in the second transport direction D2. In the second screw auger 73, a plurality of plate-shaped transport blades 73*c* are provided on the rotational shaft 73*a* at a part adjacent to the second connection portion 68. The plate-shaped transport blades 73*c* lift the developer 8 to the first transport path 63. In the second screw auger 73, a reverse transport blade 73*d* is helically coiled around the rotational shaft 73*a* at a downstream end in the second transport direction D2. The reverse transport blade 73*d* is coiled in a direction opposite to the coiling direction of the forward transport blade 73*b*. The reverse transport blade 73*d* transports the developer 8 in a direction opposite to the second transport direction D2.

The first screw auger 72 and the second screw auger 73 are rotatably attached to the left and right side walls 62*c* and 62*d* of the containing portion 62 or to the support frame (not illustrated). The rotational power to be transmitted to the developing sleeve 71*a* of the developing roller 71 is distributed to the first screw auger 72 and the second screw auger 73 via a gear train mechanism (not illustrated). Therefore, the first screw auger 72 and the second screw auger 73 rotate at appropriate speeds in appropriate directions such as arrow directions in FIG. 2.

As illustrated in FIG. 2 and FIG. 4, the developing device 6A includes a plate-shaped trimmer 74, a movement assist member 75, and a first adjusting member 76A in the containing portion 62.

The plate-shaped trimmer 74 is an example of a second adjusting member that finally adjusts the amount (layer thickness) of the developer 8 to be carried on the developing roller 71 before the developer 8 reaches the developing region Ed.

As illustrated in FIG. 4 and FIG. 5, the plate-shaped trimmer 74 is a plate-shaped non-magnetic member elongated along a direction of a rotational axis of the developing sleeve 71*a*. In the plate-shaped trimmer 74, the lower end is a tapered tip 74*a*, and a surface opposite to the opening 61 of the housing 60 is a curved guide surface 74*b* that guides the developer toward the first screw auger 72.

Figure 6:
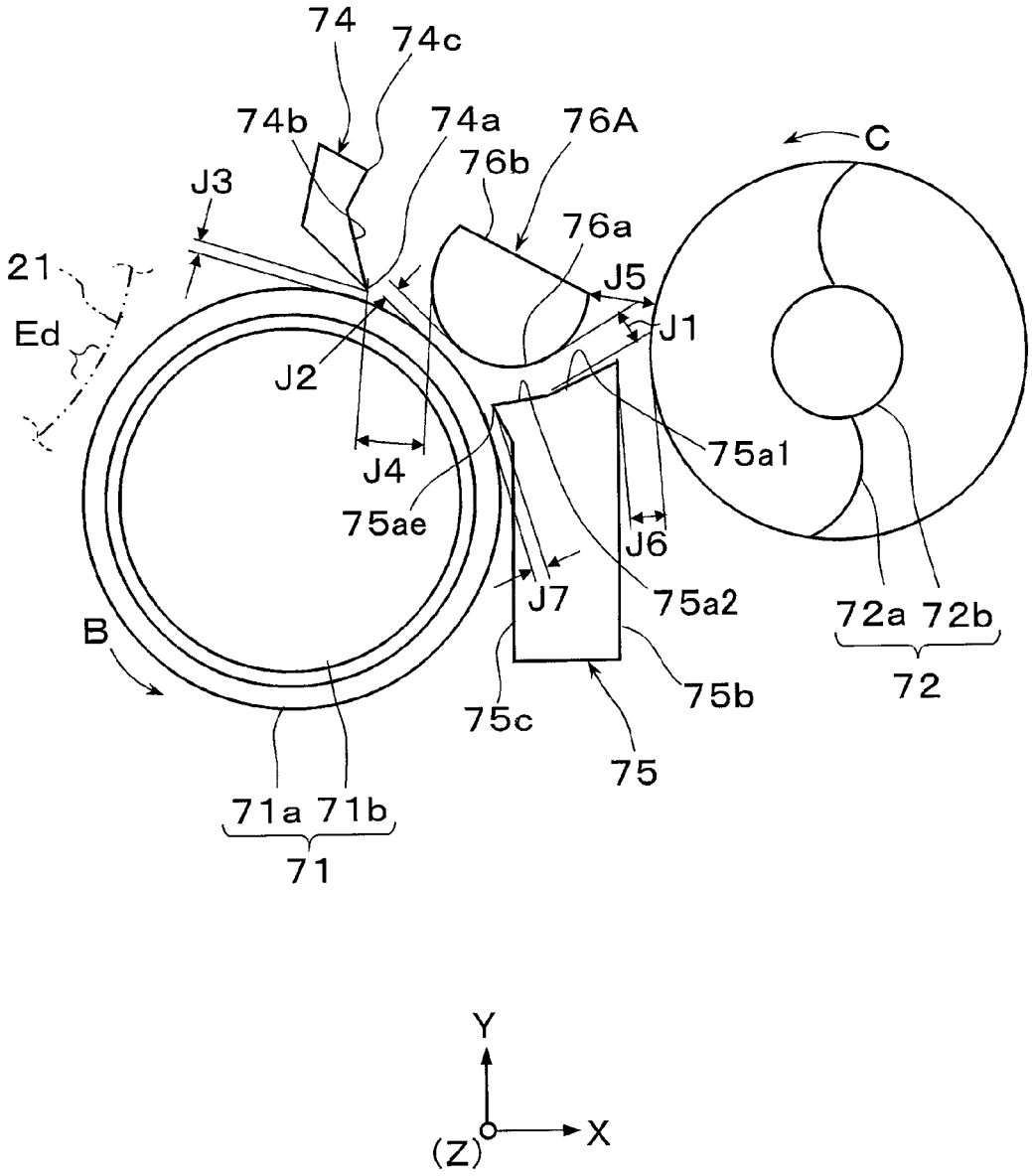
FIG. 6 illustrates a part of the developing device.

The plate-shaped trimmer 74 is arranged near the opening 61 in the upper portion 60*b* of the housing 60. As illustrated in FIG. 6, the plate-shaped trimmer 74 is attached to a predetermined part of the lower portion 60*a* or the upper portion 60*b* of the housing 60 or the support frame (not illustrated) in a state in which the tapered tip 74*a* has a predetermined minimum distance J3 from the outer peripheral surface of the developing roller 71 (developing sleeve 71*a*) and faces the outer peripheral surface along the direction of the rotational axis of the developing sleeve 71*a*.

The movement assist member 75 is a non-magnetic member arranged between the developing roller 71 and the first screw auger 72, and having a slope 75*a* that receives the developer 8 from the first screw auger 72 and moves the developer 8 to the developing roller 71.

As illustrated in FIG. 4 and FIG. 5, the movement assist member 75 is a plate-shaped non-magnetic member extending along the direction of the rotational axis of the developing sleeve 71*a*.

The movement assist member 75 has the slope 75*a* at the upper end. The slope 75*a* has a downward gradient toward the developing sleeve 71*a* at an inclination angle at which the developer 8 is slidable by the self-weight. In the movement assist member 75, a side surface 75*b* near the first screw auger 72 is a wall extending from the upper end to the vicinity of the upper portion of the second screw auger 73 substantially along the gravity direction, and a side surface 75*c* near the developing roller 71 is a wall extending from the upper end to a position reaching the lower portion of the developing roller 71 substantially along the gravity direction.

For example, the slope 75*a* of the movement assist member 75 is positioned above an imaginary line connecting a rotational center point of the developing roller 71 and a rotational center point of the first screw auger 72. As illustrated in FIG. 4 and FIG. 6, the movement assist member 75 is attached to a predetermined part of the lower portion 60*a* or the upper portion 60*b* of the housing 60 or the support frame (not illustrated) in a state in which a minimum distance J6 from the first screw auger 72 and a minimum distance J7 from the developing roller 71 are predetermined values.

The first adjusting member 76A is a non-magnetic member that adjusts a movement amount of the developer 8 from the movement assist member 75 to the developing roller 71 and a carrying amount of the developer 8 on the surface of the developing roller 71, and has a facing surface 76*a* that faces, with distances, the slope 75*a* of the movement assist member 75 and the surface of the developing roller 71 at a part passing over the movement assist member 75.

In this exemplary embodiment, the first adjusting member 76A is obtained by cutting out a part of a columnar bar member along a plane. Therefore, the first adjusting member 76A except longitudinal end surfaces has a curved surface corresponding to the outer peripheral surface of the column, and a flat surface 76*b* other than the curved surface.

The curved surface of the first adjusting member 76A is the curved facing surface 76*a* projecting toward the slope 75*a* of the movement assist member 75 and the surface of the developing roller 71. As illustrated in FIG. 4 and FIG. 6, the first adjusting member 76A is attached to a predetermined part of the lower portion 60*a* or the upper portion 60*b* of the housing 60 or the support frame (not illustrated) in a state in which a minimum distance J1 between the facing surface 76*a* and the slope 75*a* of the movement assist member 75 and a minimum distance J2 between the facing surface 76*a* and the developing roller 71 are predetermined values. The first adjusting member 76A is arranged in a state in which a minimum distance J5 from the first screw auger 72 is a predetermined value.

As illustrated in FIG. 5, the developing device 6A has a first clearance E1 as a passage of the developer 8 between the slope 75*a* of the movement assist member 75 and the facing surface 76*a* of the first adjusting member 76A, a second clearance E2 as a passage of the developer 8 between the facing surface 76*a* of the first adjusting member 76A and the surface of the developing sleeve 71*a*, and a third clearance E3 as a passage of the developer 8 between the tip 74*a* of the plate-shaped trimmer 74 and the surface of the developing sleeve 71*a*.

The developing device 6A has a fourth clearance E4 between the facing surface 76*a* of the first adjusting member 76A and the guide surface 74*b* of the plate-shaped trimmer 74, and a fifth clearance E5 between the first screw auger 72 and the side surface 75*b* of the movement assist member 75. The fifth clearance E5 substantially corresponds to a clearance between the first screw auger 72 and the first transport path 63.

The developing device 6A operates as follows.

At a timing of the developing operation, the developing sleeve 71*a* of the developing roller 71 of the developing device 6A illustrated in FIG. 2 starts to rotate in the arrow B direction, and the first screw auger 72 and the second screw auger 73 start to rotate in the arrow directions.

As illustrated in FIG. 2 and FIG. 3, the developer 8 in the second transport path 64 is transported forward in the second transport direction D2 while being stirred by the helical forward transport blade 73*b* of the rotating second screw auger 73. At this time, the toner of the two-component developer 8 is triboelectrically charged at an appropriate polarity (e.g., a negative polarity) by the carrier. As indicated by a broken arrow D3 in FIG. 3, the developer 8 transported forward to the downstream side in the second transport direction D2 along the second transport path 64 is lifted toward the first transport path 63 at the second connection portion 68 by a transport force of the plate-shaped transport blades 73*c* while receiving a reverse transport force of the helical reverse transport blade 73*d*.

As illustrated in FIG. 3 and FIG. 4, the developer 8 in the first transport path 63 is transported forward in the first transport direction D1 while being stirred by the helical forward transport blade 72*b* of the first screw auger 72 rotating in an arrow C direction.

As illustrated in FIG. 5, a part of the developer 8 transported forward by the first screw auger 72 is transported as a developer 8*a* toward the developing roller 71 over the first transport path 63 by action of the helical forward transport blade 72*b* rotating in the arrow C direction.

As illustrated in FIG. 5, the developer 8*a* sent out from the first screw auger 72 enters the first clearance E1 between the slope 75*a* of the movement assist member 75 and the facing surface 76*a* of the first adjusting member 76A. At this time, the developer 8 that does not enter the first clearance E1 is transported forward by the first screw auger 72 again in the first transport path 63, and is partially sent out from the first transport path 63 again.

As illustrated in FIG. 5, a developer 8*b* that has entered the first clearance E1 slides along the slope 75*a* of the movement assist member 75 with its passing amount limited. The passed developer 8*b* reaches the outer peripheral surface of the developing sleeve 71*a* of the developing roller 71, and is carried while forming a magnetic brush by a magnetic force from the magnet roller 71*b*. To be exact, the developer 8*b* is attracted to the surface of the developing sleeve 71*a* by receiving the magnetic force from the magnet roller 71*b* before reaching the outer peripheral surface of the developing sleeve 71*a*.

Thus, the movement amount of the developer 8*a* to the developing roller 71 is adjusted.

As illustrated in FIG. 5, a developer 8*c* supplied to and carried on the outer peripheral surface of the developing sleeve 71*a* is transported by the rotation of the developing sleeve 71*a* in the arrow B direction, and passes through the second clearance E2 between the first adjusting member 76A and the outer peripheral surface of the developing sleeve 71*a*. At this time, the developer 8*c* moves with its passing amount limited by the second clearance E2. Thus, the carrying amount of the developer 8*c* on the outer peripheral surface of the developing sleeve 71*a* is once adjusted.

The developer 8*c* carried on the outer peripheral surface of the developing sleeve 71*a* and passing over the first adjusting member 76A passes through the third clearance E3 between the plate-shaped trimmer 74 and the developing sleeve 71*a*. At this time, the developer 8*c* whose carrying amount is once adjusted moves with its passing amount limited again by the third clearance E3. Thus, the carrying amount of a developer 8*d* on the outer peripheral surface of the developing sleeve 71*a* is finally adjusted.

The developer 8*d* whose carrying amount is finally adjusted by passing under the trimmer 74 reaches and is transported through the developing region Ed of the photoconductor drum 21 by the rotation of the developing sleeve 71*a* in the arrow B direction.

In the developing region Ed, the toner of the developer 8*d* is used for developing a latent image on the photoconductor drum 21 by reciprocally moving with a developing field formed between the photoconductor drum 21 and the developing sleeve 71*a* by the developing bias and partially adhering to the latent image by an electrostatic force.

A partial developer 8*e* that is not used for the development passes through the developing region Ed and then returns to the second transport path 64 by being separated from the developing sleeve 71*a* with a magnetic force of a repulsive magnetic field generated by the separation poles S3 and N3 in the containing portion 62.

In the developer 8*c* that has passed over the first adjusting member 76A, a surplus developer 8*f* that has not passed through the third clearance E3 between the outer peripheral surface of the developing sleeve 71*a* and the plate-shaped trimmer 74 is transported to the fourth clearance E4 between the facing surface 76*a* of the first adjusting member 76A and the guide surface 74*b* of the plate-shaped trimmer 74 as illustrated in FIG. 5.

At this time, the developer 8*f* returns toward the first screw auger 72 by the guide surface 74*b* of the trimmer 74. A part of the developer 8*f* slides along the flat surface 76*b* of the first adjusting member 76A having a downward gradient toward the first screw auger 72, and returns to a space between the first adjusting member 76A and the first screw auger 72.

For example, in a case where the developing device 6A does not have the first adjusting member 76A, the developer 8 is supplied from the first screw auger 72 to the developing roller 71, but the amount of the developer 8 supplied to an upstream part of the developing roller 71 in the arrow B rotational direction of the developing sleeve 71*a* relative to the plate-shaped trimmer 74 may become unstable, and more developer 8 may stagnate in the upstream part.

Due to the unstable amount of the developer 8 supplied to the developing region Ed and the stagnation of the developer 8, the developer 8 is likely to have stress, thereby causing image quality degradation such as white streaks on the developed toner image along the transport direction of the recording paper 9.

<Detailed Structure of Developing Device>

As illustrated in FIG. 2 to FIG. 6, the developing device 6A includes the first adjusting member 76A, and the minimum distance J1 between the slope 75*a* of the movement assist member 75 and the facing surface 76*a* of the first adjusting member 76A, the minimum distance J2 between the facing surface 76*a* of the first adjusting member 76A and the surface of the developing roller 71, and the minimum distance J3 between the surface of the plate-shaped trimmer 74 and the developing roller 71 are reduced in descending order.

For example, the relationship among the three minimum distances J1, J2, and J3 (J1>J2>J3) may be established by setting the minimum distance J3 first and then setting the remaining minimum distances J1 and J2.

For example, when the minimum distance J3 is set to K, the relationship among the three minimum distances J1, J2, and J3 (J1>J2>J3) may be established by setting the minimum distance J2 within a range of 2K to 5K and setting the minimum distance J1 within a range of 5K to 12K.

In the developing device 6A, the minimum distance J5 between the first adjusting member 76A and the first screw auger 72 is set larger than the minimum distance J1 between the slope 75*a* of the movement assist member 75 and the facing surface 76*a* of the first adjusting member 76A (J5>J1). The minimum distance J6 between the movement assist member 75 and the first screw auger 72 is set smaller than the minimum distance J5 (J6<J5). The minimum distance J7 between the side surface 75*c* of the movement assist member 75 and the developing roller 71 is set smaller than the minimum distance J2 between the facing surface 76*a* of the first adjusting member 76A and the surface of the developing roller 71 (J7<J2).

In the developing device 6A, the developer 8*a* transported from the first screw auger 72 first passes through the first clearance E1 between the slope 75*a* of the movement assist member 75 and the facing surface 76*a* of the first adjusting member 76A, thereby adjusting the amount of the developer 8*a* to be supplied to the outer peripheral surface of the developing roller 71.

In the developing device 6A, the developer 8 then passes through the second clearance E2 between the facing surface 76*a* of the first adjusting member 76A and the outer peripheral surface of the developing roller 71. The second clearance E2 has the minimum distance J2 smaller than the minimum distance J1 of the first clearance E1.

When the developer 8 sent out from the first screw auger 72 and then carried on the outer peripheral surface of the developing roller 71 reaches the trimmer 74, the carrying amount is adjusted.

In the developing device 6A illustrated in FIG. 5, the slope 75*a* of the movement assist member 75 and the facing surface 76*a* of the first adjusting member 76A become closer to each other toward the developing roller 71 to reach the minimum distance J1.

In the developing device 6A illustrated in FIG. 5, the facing surface 76*a* of the first adjusting member 76A is the curved surface projecting toward the slope 75*a* of the movement assist member 75 and the outer peripheral surface of the developing roller 71.

In the developing device 6A illustrated in FIG. 5, a minimum distance J4 between the facing surface 76*a* of the first adjusting member 76A and the tip 74*a* of the trimmer 74 having the minimum distance J3 from the developing roller 71 is larger than the minimum distance J2 between the facing surface 76*a* of the first adjusting member 76A and the outer peripheral surface of the developing roller 71 (J4>J2).

In the developing device 6A illustrated in FIG. 5, the guide surface 74*b* of the trimmer 74 that is opposite to the surface facing the outer peripheral surface of the developing roller 71 is the curved surface having a gradually increasing distance from the first adjusting member 76A.

As illustrated in FIG. 5, the developing device 6A has the pickup pole N1 on the magnet roller 71*b* of the developing roller 71. A peak MLp of a magnetic flux ML of the pickup pole N1 is offset from a terminal end 75*ae* of the slope 75*a* of the movement assist member 75 to an upstream side in the rotational direction B of the developing roller 71. The peak MLp of the magnetic flux ML is measured by, for example, a magnetic flux density measurer (MFD-04 manufactured by Clover Engineering Co., Ltd.).

Figure 7:
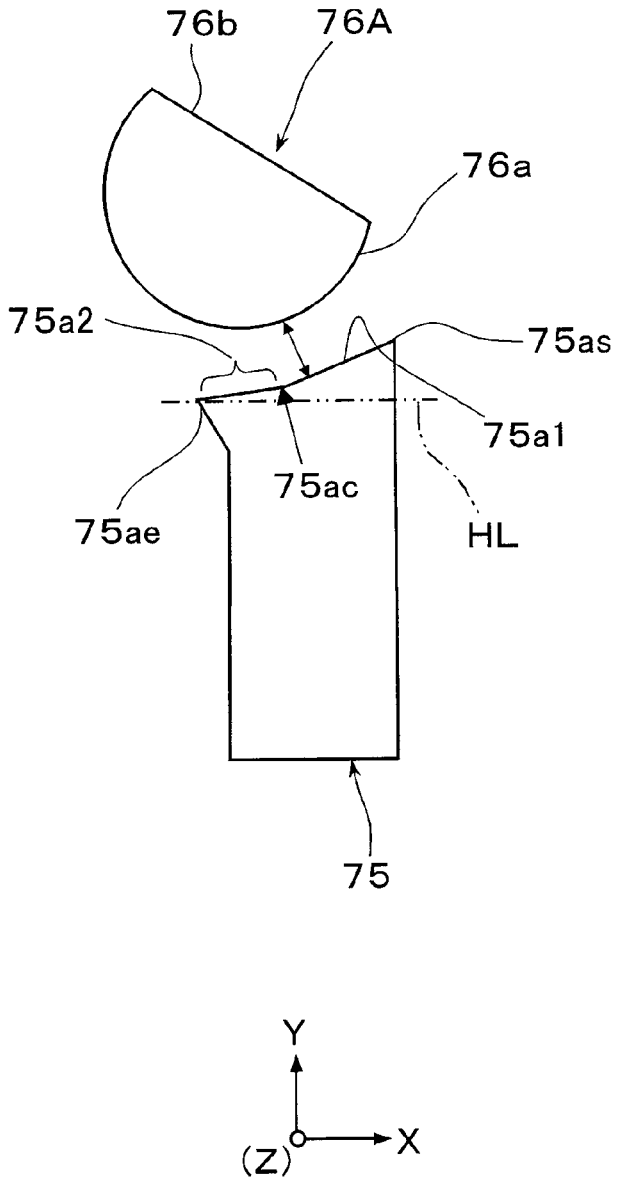
FIG. 7 illustrates a modified example of a movement assist member.

In the slope 75*a* of the movement assist member 75 of the developing device 6A illustrated in FIG. 7, the inclination of a second slope 75*a*2 near the developing roller 71 may be gentler than the inclination of a first slope 75*a*1 that is the remaining portion leading to the second slope 75*a*2. In FIG. 7, a two-dot chain line HL represents a horizontal line (plane).

The developer 8*a* reaching the second slope 75*a*2 from the first slope 75*a*1 does not slide forcefully due to the gentler inclination. Since the second slope 75*a*2 is near the developing roller 71, the developer 8*a* moves toward the developing roller 71 by being attracted by the magnetic force from the magnet roller 71*b*.

Second Exemplary Embodiment

Figure 8:
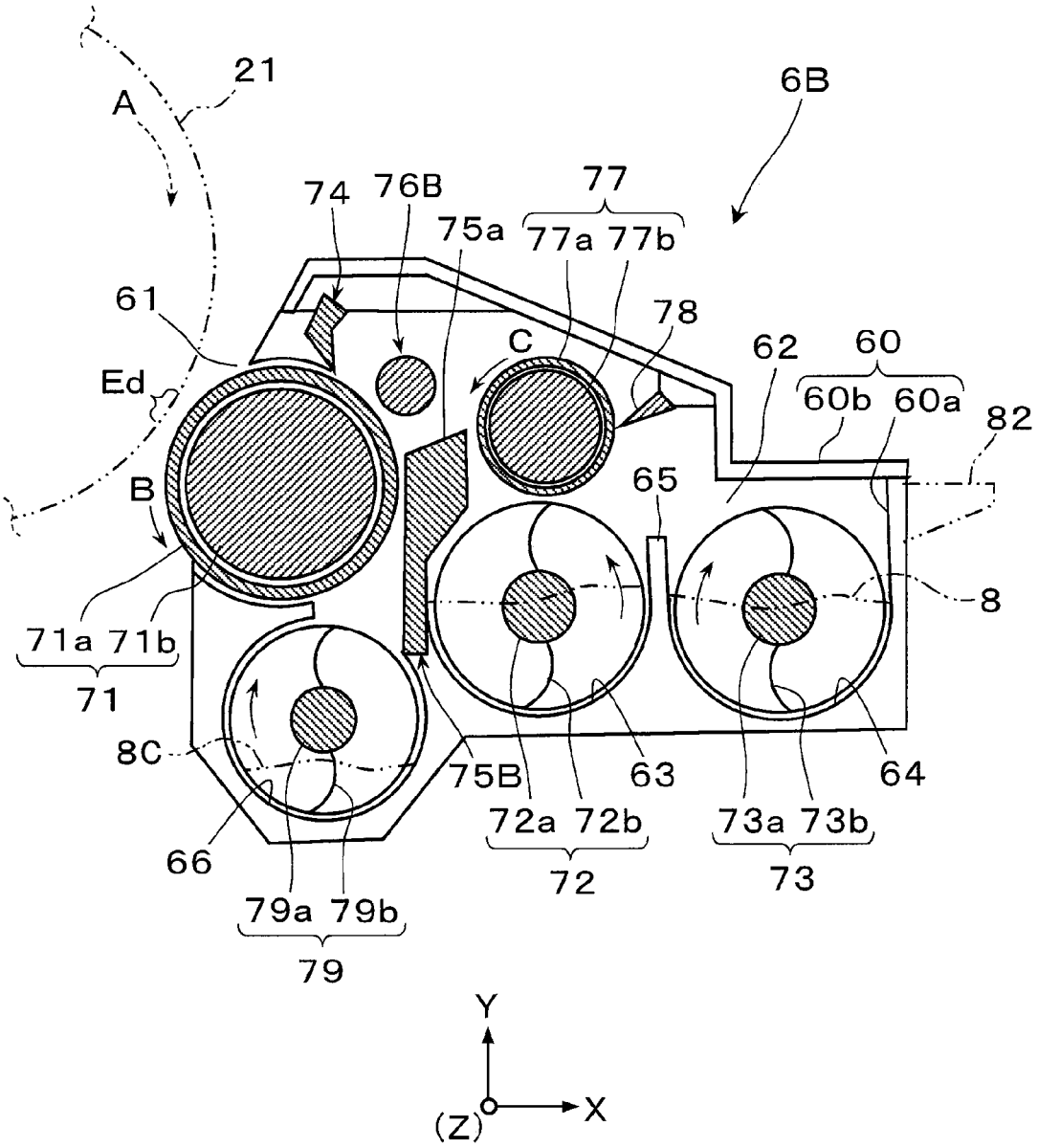
FIG. 8 illustrates a developing device according to a second exemplary embodiment.

FIG. 8 illustrates a developing device 6B according to a second exemplary embodiment of the present disclosure.

The developing device 6B according to the second exemplary embodiment differs from the developing device 6A according to the first exemplary embodiment in that the first screw auger 72 and the second screw auger 73 are arrayed substantially horizontally, the first adjusting member 76A is changed to a first adjusting member 76B, and a relay transport roller 77, a second trimmer 78, and a third screw auger 79 are added. The other structure is identical to that of the first exemplary embodiment.

In the following description, common components are represented by the reference symbols used in the first exemplary embodiment to omit their description unless otherwise needed.

Figure 9:
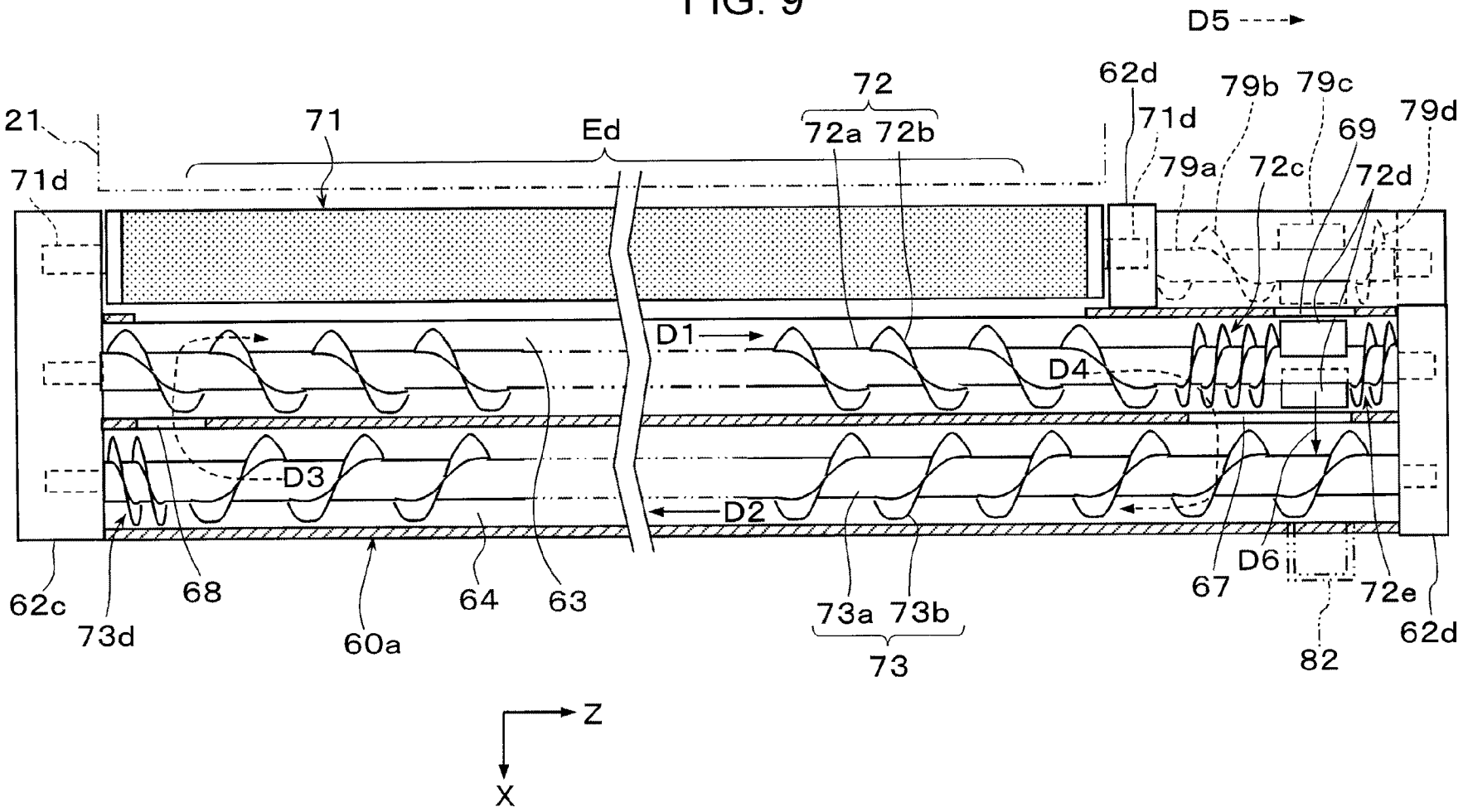
FIG. 9 illustrates a part of the developing device of FIG. 8.

In the developing device 6B illustrated in FIG. 8 and FIG. 9, the first transport path 63 and the second transport path 64 are arrayed substantially horizontally in the containing portion 62 of the lower portion 60*a* of the housing 60. The first screw auger 72 is rotatably arranged in the first transport path 63. The second screw auger 73 is rotatably arranged in the second transport path 64.

Figure 10:
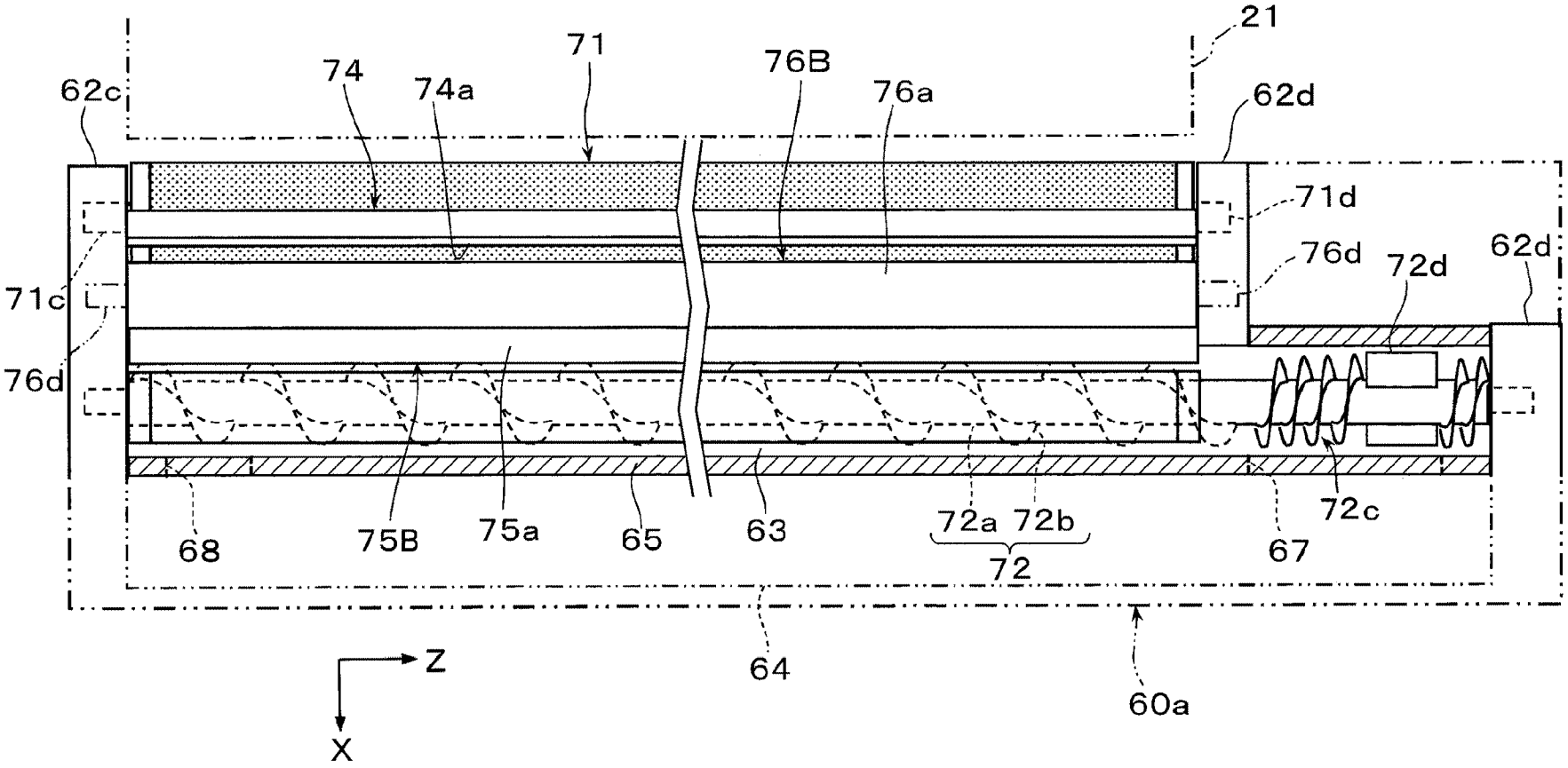
FIG. 10 illustrates the developing device of FIG. 8 with its upper housing portion removed.
Figure 11:
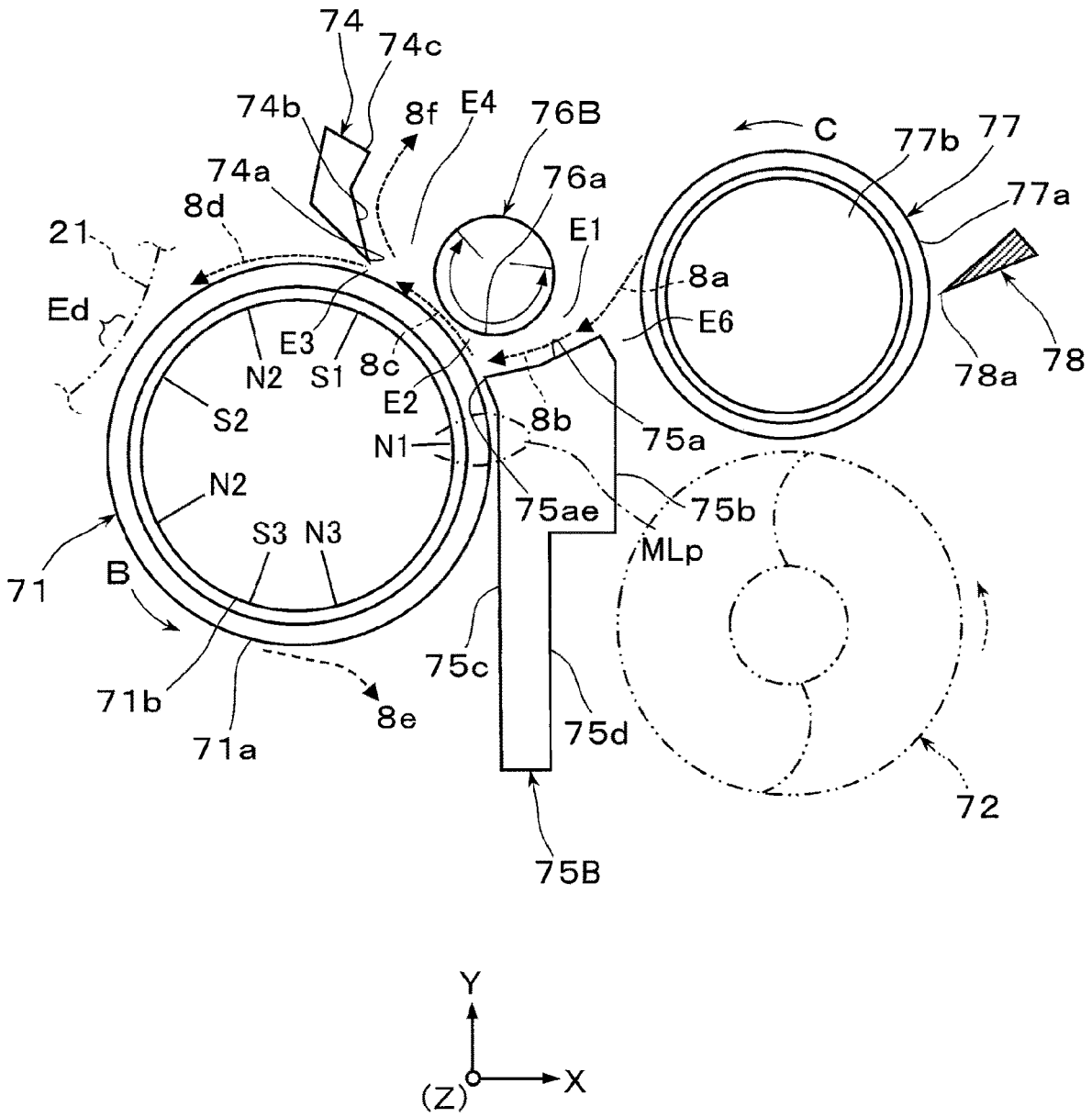
FIG. 11 illustrates a part of the developing device of FIG. 8 and its operating state.

In the developing device 6B illustrated in FIG. 8, FIG. 10, and FIG. 11, the first adjusting member 76B is a columnar non-magnetic member. For example, the curved outer peripheral surface of the columnar first adjusting member 76B in a range indicated by a double-headed arrow in FIG. 11 is the facing surface 76*a* that faces, with distances, the slope 75*a* of a movement assist member 75B and the surface of the developing roller 71 at a part passing over the movement assist member 75B.

Similarly to the first adjusting member 76A of the first exemplary embodiment, the first adjusting member 76B is attached to a predetermined part of the lower portion 60*a* or the upper portion 60*b* of the housing 60 or the support frame (not illustrated) in a state in which the minimum distance J1 between the facing surface 76*a* that is the outer peripheral surface of the first adjusting member 76B and the slope 75*a* of the movement assist member 75B and the minimum distance J2 between the facing surface 76*a* and the developing roller 71 are predetermined values. The first adjusting member 76B is arranged in a state in which the minimum distance J5 from the relay transport roller 77 is a predetermined value.

As illustrated in FIG. 8, FIG. 10, and FIG. 11, the developing device 6B includes the relay transport roller 77 that is another example of the supply transport member that transports the developer 8 to be supplied to the developing roller 71. The relay transport roller 77 is arranged above the first screw auger 72 with an appropriate distance. The relay transport roller 77 carries a part of the developer 8 transported forward by the first screw auger 72, and then relays the developer 8 toward the developing roller 71.

The relay transport roller 77 is similar to the developing roller 71, and includes a cylindrical transport sleeve 77*a* that rotates while carrying the developer 8, and a magnet roller 77*b* fixed in an internal space of the transport sleeve 77*a*.

The transport sleeve 77*a* is made of a non-magnetic material. The transport sleeve 77*a* is driven to rotate in the arrow C direction by distributing rotational power to be transmitted to the developing roller 71 or the first screw auger 72. The magnet roller 77*b* has a plurality of magnetic poles (not illustrated) that generate magnetic forces for exerting functions of attracting (picking up), carrying, and separating the developer 8 on the surface of the transport sleeve 77*a*. A separation pole is arranged on the magnet roller 77*b* at a part slightly above a position where the magnet roller 77*b* faces the slope 75*a* of the movement assist member 75B.

The plate-shaped second trimmer 78 is provided near a downstream part of the transport sleeve 77*a* of the relay transport roller 77 in the rotational direction C relative to the first screw auger 72. The second trimmer 78 is an example of a member that adjusts the amount (layer thickness) of the developer 8 to be carried on the transport sleeve 77*a*.

The second trimmer 78 is attached in a state in which a tapered tip 78*a* faces the outer peripheral surface of the relay transport roller 77 (transport sleeve 77*a*) with an appropriate distance parallel to a direction of a rotational axis of the transport sleeve 77*a*.

Similarly to the movement assist member 75 of the first exemplary embodiment, the movement assist member 75B is a non-magnetic member arranged between the relay transport roller 77 and an upstream part of the developing roller 71 in the rotational direction B relative to the trimmer 74 and having the slope 75*a* that receives the developer 8 from the relay transport roller 77 and moves the developer 8 to the developing roller 71.

The movement assist member 75B of the second exemplary embodiment has a lower side portion 75*d* below the side surface 75*b* that faces the relay transport roller 77. The lower side portion 75*d* is recessed by cutting out the movement assist member 75B toward the developing roller 71 to secure an arrangement space for the first screw auger 72. In the movement assist member 75B, the side surface 75*c* that faces the developing roller 71 serves as a part of a partition wall by extending to the vicinity of an upper portion of the third screw auger 79.

As illustrated in FIG. 8, FIG. 10, and FIG. 11, the developing device 6B includes the third screw auger 79 that is an example of a third transport member that finally returns, to the second transport path 64, at least a part of the developer 8*e* separated after passing through the developing region Ed of the developing roller 71.

The third screw auger 79 is arranged in a third transport path 66 provided below the developing roller 71 in the lower portion 60*a* of the housing 60 parallel to the rotational axis of the developing roller 71. The developer 8*e* separated from the developing roller 71 is transported to the third transport path 66. As illustrated in FIG. 8 and FIG. 9, the third transport path 66 is a groove that is open and connected at a part facing a part of the developing roller 71 where the developer 8 is separated. The third transport path 66 is connected, via a penetrating third connection portion 69, to the first connection portion 67 in the first transport path 63 at a part behind a downstream end in a third transport direction in which the developer 8*e* is transported (depth direction Z in this example).

In the third screw auger 79, a forward transport blade 79*b* is helically coiled around a round rotational shaft 79*a* at a predetermined height, a predetermined inclination angle, and a predetermined pitch. The rotational shaft 79*a* rotates in the third transport path 66. The forward transport blade 79*b* transports the separated developer 8*e* forward in a third transport direction D5.

In the third screw auger 79, a plurality of plate-shaped transport blades 79*c* are provided upright from the rotational shaft 79*a* at a part adjacent to the third connection portion 69. The plate-shaped transport blades 79*c* transport the developer 8*e* to the first transport path 63 adjacent to the first connection portion 67. In the third screw auger 79, a reverse transport blade 79*d* is helically coiled around the rotational shaft 79*a* at a downstream part in the third transport direction relative to the plate-shaped transport blades 79*c*. The reverse transport blade 79*d* transports the developer 8*e* in a direction opposite to the third transport direction D5.

Figure 12:
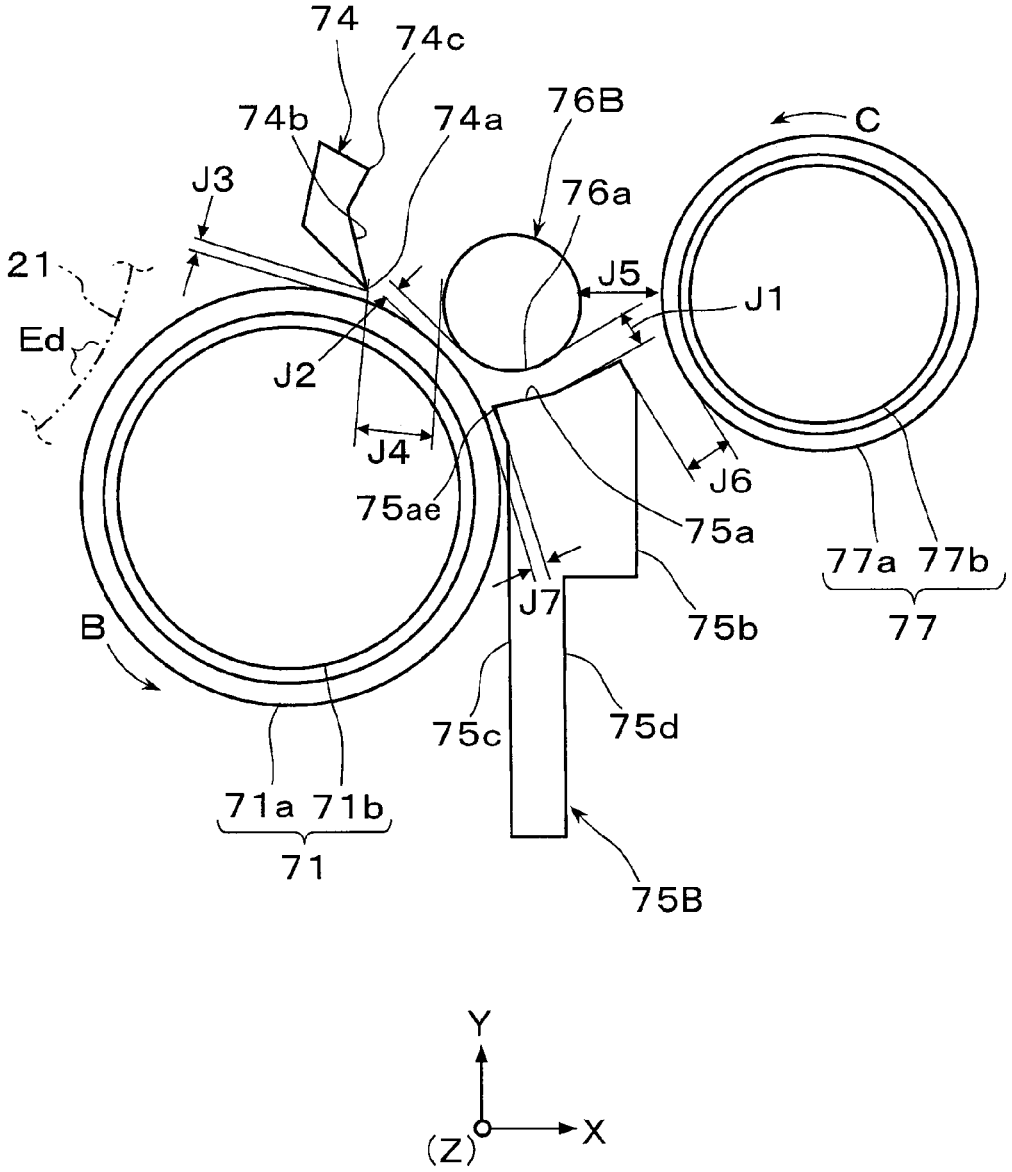
FIG. 12 illustrates a part of the developing device of FIG. 8.

In the developing device 6B illustrated in FIG. 12, the minimum distance J1 between the slope 75*a* of the movement assist member 75B and the facing surface 76*a* of the first adjusting member 76B, the minimum distance J2 between the facing surface 76*a* of the first adjusting member 76B and the surface of the developing roller 71, and the minimum distance J3 between the surface of the plate-shaped trimmer 74 and the developing roller 71 are reduced in descending order substantially similarly to the developing device 6A according to the first exemplary embodiment.

In the developing device 6B, the minimum distance J5 between the first adjusting member 76B and the relay transport roller 77 is set larger than the minimum distance J1 between the slope 75*a* of the movement assist member 75B and the facing surface 76*a* of the first adjusting member 76B (J5>J1). The minimum distance J6 between the movement assist member 75B and the relay transport roller 77 is set smaller than the minimum distance J5 (J6<J5). The minimum distance J7 between the side surface 75*c* of the movement assist member 75B and the developing roller 71 is set smaller than the minimum distance J2 between the facing surface 76*a* of the first adjusting member 76B and the surface of the developing roller 71 (J7<J2).

The developing device 6B operates as follows.

At a timing of the developing operation, the developing sleeve 71*a* of the developing roller 71 of the developing device 6B illustrated in FIG. 8 starts to rotate in the arrow B direction, and the transport sleeve 77*a* of the relay transport roller 77, the first screw auger 72, the second screw auger 73, and the third screw auger 79 start to rotate in arrow directions.

As illustrated in FIG. 8 and FIG. 9, the developer 8 in the second transport path 64 is transported forward in the second transport direction D2 while being stirred by the helical forward transport blade 73*b* of the rotating second screw auger 73. As indicated by the broken arrow D3 in FIG. 9, the developer 8 transported forward to the downstream side in the second transport direction D2 along the second transport path 64 is transported toward the first transport path 63 at the second connection portion 68 while receiving the reverse transport force of the helical reverse transport blade 73*d*.

The developer 8 in the first transport path 63 is transported forward in the first transport direction D1 while being stirred by the helical forward transport blade 72*b* of the rotating first screw auger 72.

Above the first transport path 63, a part of the developer 8 transported forward by the first screw auger 72 is carried on the outer peripheral surface of the transport sleeve 77*a* of the relay transport roller 77 by a magnetic force, and then transported by the rotation of the transport sleeve 77*a* in the arrow C direction.

As indicated by a broken arrow D4 in FIG. 9, the developer 8 transported forward by the first screw auger 72 without being carried on the relay transport roller 77 is transported toward the second transport path 64 at the first connection portion 67 while receiving a reverse transport force of the helical reverse transport blade 72*c*.

When the developer 8 carried on the transport sleeve 77*a* of the relay transport roller 77 passes over the second trimmer 78, the carrying amount is adjusted by restricting passage of a surplus by the second trimmer 78. The surplus developer 8 drops back to the first transport path 63 and is transported forward in the first transport direction by the first screw auger 72, but may partially be carried on the relay transport roller 77 again.

As illustrated in FIG. 11, the developer 8*a* that is a part of the developer 8 carried on the relay transport roller 77 after passing over the second trimmer 78 is transported toward the developing roller 71 by being separated from the surface of the transport sleeve 77*a* with a magnetic force of a repulsive magnetic field of the separation pole before passing over the slope 75*a* of the movement assist member 75B.

As illustrated in FIG. 11, the developer 8*a* sent out from the relay transport roller 77 enters the first clearance E1 between the slope 75*a* of the movement assist member 75B and the facing surface 76*a* of the first adjusting member 76B. At this time, the developer 8 that does not enter the first clearance E1 returns to the first transport path 63 and is transported forward by the first screw auger 72 again, or remains carried on the relay transport roller 77.

As illustrated in FIG. 11, the developer 8*b* that has entered the first clearance E1 slides along the slope 75*a* of the movement assist member 75B with its passing amount limited. The passed developer 8*b* reaches the outer peripheral surface of the developing sleeve 71*a* of the developing roller 71, and is carried while forming a magnetic brush by the magnetic force from the magnet roller 71*b*.

Thus, the movement amount of the developer 8*a* to the developing roller 71 is adjusted.

As illustrated in FIG. 11, the developer 8*c* supplied to and carried on the outer peripheral surface of the developing sleeve 71*a* is transported by the rotation of the developing sleeve 71*a* in the arrow B direction, and passes through the second clearance E2 between the first adjusting member 76B and the outer peripheral surface of the developing sleeve 71*a*. At this time, the developer 8*c* moves with its passing amount limited by the second clearance E2. Thus, the carrying amount of the developer 8*c* on the outer peripheral surface of the developing sleeve 71*a* is once adjusted.

On the developing roller 71, the developer 8 passing through the second clearance E2 is transported in the arrow B direction and passes over the trimmer 74. At this time, passage of a surplus of the developer 8 carried on the outer peripheral surface of the developing sleeve 71*a* is restricted by the trimmer 74 to adjust the carrying amount, and then the developer 8 passes through the developing region Ed of the photoconductor drum 21.

In the developing region Ed, a part of the toner of the developer 8 carried on the outer peripheral surface of the developing sleeve 71*a* of the developing roller 71 is used for developing a latent image on the photoconductor drum 21 by adhering to the latent image by an electrostatic force. The developer 8*e* that is not used for the development passes through the developing region Ed and then drops into the third transport path 66 by being separated from the developing sleeve 71*a* with the magnetic force of the repulsive magnetic field of the separation poles of the magnet roller 71*b* in the containing portion 62.

As illustrated in FIG. 8 and FIG. 9, the developer 8*e* dropping into the third transport path 66 by being separated from the developing sleeve 71*a* is transported forward to the downstream side in the third transport direction D5 by the forward transport blade 79*b* of the rotating third screw auger 79.

The developer 8*e* transported forward to the downstream side of the third transport path 66 in the third transport direction D5 is transported to the first transport path 63 by the plate-shaped transport blades 79*c* at the part adjacent to the third connection portion 69. As indicated by an arrow D6 in FIG. 9, the developer 8*e* transported to the first transport path 63 is transported to the second transport path 64 by plate-shaped transport blades 72*d* of the first screw auger 72. Finally, the developer 8*e* transported to the second transport path 64 is transported forward in the second transport direction D2 by the second screw auger 73, and is mixed with the developer 8 existing in the second transport path 64.

In the developing device 6B, the developer 8*a* transported from the relay transport roller 77 first passes through the first clearance E1 between the slope 75*a* of the movement assist member 75B and the facing surface 76*a* of the first adjusting member 76B, thereby adjusting the amount of the developer 8*a* to be supplied to the outer peripheral surface of the developing roller 71.

In the developing device 6B, the developer 8 then passes through the second clearance E2 between the facing surface 76*a* of the first adjusting member 76B and the outer peripheral surface of the developing roller 71. The second clearance E2 has the minimum distance J2 smaller than the minimum distance J1 of the first clearance E1.

When the developer 8 sent out from the relay transport roller 77 and then carried on the outer peripheral surface of the developing roller 71 reaches the trimmer 74, the carrying amount is adjusted.

In the slope 75*a* of the movement assist member 75B of the developing device 6B, the inclination of the second slope 75*a*2 near the developing roller 71 may be gentler than the inclination of the first slope 75*a*1 that is the remaining portion leading to the second slope 75*a*2 similarly to the developing device 6A according to the first exemplary embodiment (see FIG. 7).

Third Exemplary Embodiment

Figure 13:
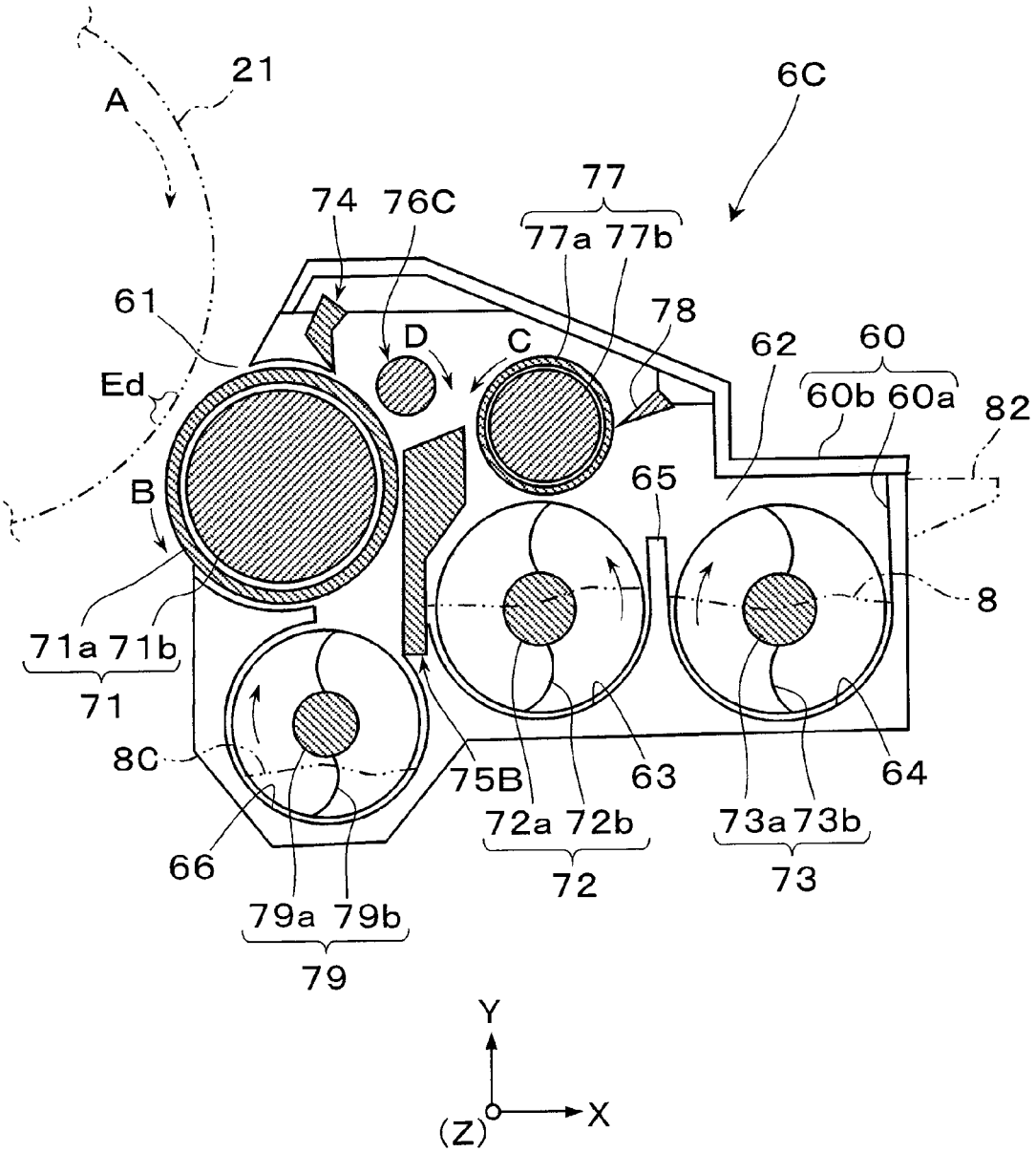
FIG. 13 illustrates a developing device according to a third exemplary embodiment.

FIG. 13 illustrates a developing device 6C according to a third exemplary embodiment of the present disclosure.

The developing device 6C according to the third exemplary embodiment differs from the developing device 6B according to the second exemplary embodiment in that the fixed first adjusting member 76B is changed to a first adjusting member 76C to be driven to rotate. The other structure is identical to that of the second exemplary embodiment.

In the following description, common components are represented by the reference symbols used in the first and second exemplary embodiments to omit their description unless otherwise needed.

Figure 14:
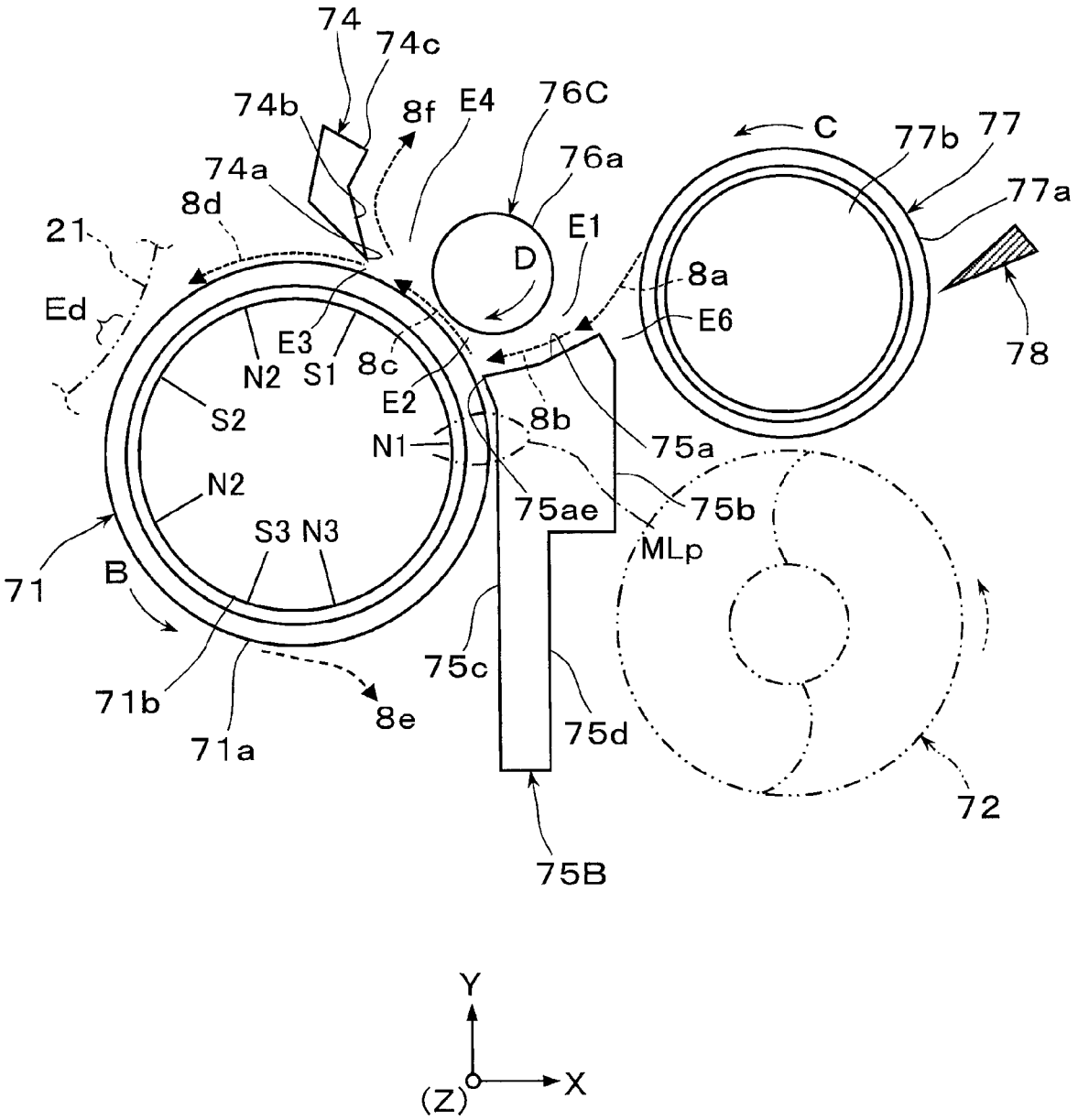
FIG. 14 illustrates a part of the developing device of FIG. 13 and its operating state.

As illustrated in FIG. 13 and FIG. 14, the columnar first adjusting member 76C is driven to rotate in an arrow D direction during operation of the developing device 6C. That is, during the operation of the developing device 6C, the first adjusting member 76C rotates in a direction in which the first adjusting member 76C passes over the outer peripheral surface of the developing roller 71 subsequently to the slope 75*a* of the movement assist member 75B.

The first adjusting member 76C rotates in the arrow D direction at an appropriate speed by distributing, via a gear train mechanism (not illustrated), rotational power to be transmitted to the developing sleeve 71*a* of the developing roller 71.

The developing device 6C basically operates similarly to the developing device 6B according to the second exemplary embodiment.

Since the first adjusting member 76C of the developing device 6C is driven to rotate in the arrow D direction, a transport force is obtained by the movement of the facing surface 76*a* that is the outer peripheral surface of the first adjusting member 76C as illustrated in FIG. 14 when the developer 8*a* sent out from the relay transport roller 77 passes through the first clearance E1 and when the surplus developer 8*f* resulting from the adjustment at the trimmer 74 passes through the fourth clearance E4.

Modified Examples

For example, the third screw auger 79 of the developing device 6B according to the second exemplary embodiment (including the structure of the third transport path 66 or the like related to the third screw auger 79) may be added to the developing device 6A according to the first exemplary embodiment.

As indicated by two-dot chain lines in FIG. 8, FIG. 9, and FIG. 13, each of the developing devices 6B and 6C according to the second and third exemplary embodiments may have an injection port 82 above a part of the second transport path 64 adjacent to the first connection portion 67. The replenishment developer 8 (including toner) is injected into the second transport path 64 through the injection port 82.

Even if the injection port 82 is provided and a part of the developer 8 injected into the second transport path 64 through the injection port 82 enters a part of the first transport path 63 adjacent to the first connection portion 67, the developer 8 returns to the second transport path 64 by the reverse transport blade 72*c* of the first screw auger 72. Thus, the injected developer 8 is appropriately transported to the second transport path 64 and transported forward in the second transport direction D2 while being stirred by the second screw auger 73.

The image forming apparatus is not limited to the image forming apparatus 1 having the structure exemplified in the first exemplary embodiment. The image forming apparatus may have any structure as long as the developing device 6A, 6B, or 6C exemplified in each exemplary embodiment of the present disclosure is applicable.

For example, the image former 2 of the image forming apparatus may use an intermediate transfer system. The image former may form a multicolor image instead of a monochrome image. The developing rotator of the developing device is not limited to the developing roller 71, and may be a belt or any other form than the roller.

The foregoing description of the exemplary embodiments of the present disclosure has been provided for the purposes of illustration and description. It is not intended to be exhaustive or to limit the disclosure to the precise forms disclosed. Obviously, many modifications and variations will be apparent to practitioners skilled in the art. The embodiments were chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

What is claimed is:

1. A developing device comprising:

a developing rotator configured to rotate through a developing region while carrying a magnetic developer;

a supply transport member configured to rotate to transport the developer to be supplied to the developing rotator;

a non-magnetic movement assist member arranged between the developing rotator and the supply transport member, and having a slope that receives the developer from the supply transport member and moves the developer to the developing rotator;

a first adjusting member having a facing surface that faces, with distances, the slope of the movement assist member and a surface of the developing rotator at a part passing over the movement assist member, and configured to adjust a movement amount of the developer from the movement assist member to the developing rotator and a carrying amount of the developer on the surface of the developing rotator; and a second adjusting member having a distance from the surface of the developing rotator at a part passing over the first adjusting member, and configured to adjust the carrying amount of the developer on the surface of the developing rotator before the developer reaches the developing region, wherein a first minimum distance between the slope of the movement assist member and the facing surface of the first adjusting member, a second minimum distance between the facing surface of the first adjusting member and the surface of the developing rotator, and a third minimum distance between the second adjusting member and the surface of the developing rotator are reduced in descending order.

2. The developing device according to claim 1, wherein the slope of the movement assist member and the facing surface of the first adjusting member become closer to each other toward the developing rotator to reach the first minimum distance.

3. The developing device according to claim 2, wherein the slope of the movement assist member comprises a first portion near the developing rotator, and a second portion that is a remaining portion leading to the first portion, and wherein inclination of the first portion is gentler than inclination of the second portion.

4. The developing device according to claim 3, wherein a fourth minimum distance between the facing surface of the first adjusting member and a part of the second adjusting member having the third minimum distance from the developing rotator is larger than the second minimum distance between the facing surface of the first adjusting member and the surface of the developing rotator.

5. The developing device according to claim 2, wherein the facing surface of the first adjusting member is a curved surface projecting toward the slope of the movement assist member and the surface of the developing rotator.

6. The developing device according to claim 5, wherein the first adjusting member is a columnar member.

7. The developing device according to claim 6, wherein the first adjusting member is drivable to rotate in a direction in which the first adjusting member passes over the surface of the developing rotator subsequently to the slope of the movement assist member.

8. The developing device according to claim 2, wherein a fourth minimum distance between the facing surface of the first adjusting member and a part of the second adjusting member having the third minimum distance from the developing rotator is larger than the second minimum distance between the facing surface of the first adjusting member and the surface of the developing rotator.

9. The developing device according to claim 1, wherein the slope of the movement assist member comprises a first portion near the developing rotator, and a second portion that is a remaining portion leading to the first portion, and wherein inclination of the first portion is gentler than inclination of the second portion.

10. The developing device according to claim 9, wherein a fourth minimum distance between the facing surface of the first adjusting member and a part of the second adjusting member having the third minimum distance from the developing rotator is larger than the second minimum distance between the facing surface of the first adjusting member and the surface of the developing rotator.

11. The developing device according to claim 1, wherein the facing surface of the first adjusting member is a curved surface projecting toward the slope of the movement assist member and the surface of the developing rotator.

12. The developing device according to claim 11, wherein the first adjusting member is a columnar member.

13. The developing device according to claim 12, wherein the first adjusting member is drivable to rotate in a direction in which the first adjusting member passes over the surface of the developing rotator subsequently to the slope of the movement assist member.

14. The developing device according to claim 11, wherein a fourth minimum distance between the facing surface of the first adjusting member and a part of the second adjusting member having the third minimum distance from the developing rotator is larger than the second minimum distance between the facing surface of the first adjusting member and the surface of the developing rotator.

15. The developing device according to claim 1, wherein the first adjusting member is a columnar member.

16. The developing device according to claim 15, wherein the first adjusting member is drivable to rotate in a direction in which the first adjusting member passes over the surface of the developing rotator subsequently to the slope of the movement assist member.

17. The developing device according to claim 1, wherein a fourth minimum distance between the facing surface of the first adjusting member and a part of the second adjusting member having the third minimum distance from the developing rotator is larger than the second minimum distance between the facing surface of the first adjusting member and the surface of the developing rotator.

18. The developing device according to claim 17, wherein a surface of the second adjusting member that is opposite to a surface facing the surface of the developing rotator is shaped to have a gradually increasing distance from the first adjusting member.

19. The developing device according to claim 1, wherein the developing rotator comprises a rotatable cylindrical member, and a magnet member arranged on an inner side of the cylindrical member and having a plurality of magnetic poles, wherein the magnetic poles comprise a pickup pole that causes a surface of the cylindrical member to carry the developer by a magnetic force, and wherein a peak of a magnetic flux of the pickup pole is offset from a terminal end of the slope of the movement assist member to an upstream side in a rotational direction of the developing rotator.

20. An image forming apparatus comprising:

a latent image carrier configured to carry a latent image; and a developing device configured to develop the latent image on the latent image carrier with a developer in a developing region, wherein the developing device is the developing device according to claim 1.

* * * * *